US005104625A

United States Patent [19]

Kenney

[11] Patent Number: 5,104,625

[45] Date of Patent: Apr. 14, 1992

[54] PIPETTER DEVICE

[75] Inventor: James W. Kenney, Broomall, Pa.

[73] Assignee: Drummond Scientific Company, Broomall, Pa.

[21] Appl. No.: 416,864

[22] Filed: Oct. 4, 1989

[51] Int. Cl.[5] ..... B01L 3/02

[52] U.S. Cl. ..... 422/100; 73/864.02; 73/864.13; 73/864.14

[58] Field of Search ..... 422/100; 401/94, 63, 401/81; 73/864.02, 864.13, 864.14

[56] References Cited

U.S. PATENT DOCUMENTS

| | | | |
|---|---|---|---|
| 338,611 | 3/1886 | Pusey | 401/94 |
| 2,959,964 | 11/1960 | Streitfeld . | |
| 3,918,308 | 11/1975 | Reed . | |
| 4,084,730 | 4/1978 | Franke et al. . | |
| 4,099,548 | 7/1978 | Sturm et al. . | |
| 4,154,108 | 5/1979 | Volliger et al. . | |
| 4,362,063 | 12/1982 | d'Autry | 73/864.18 X |
| 4,474,071 | 10/1984 | d'Autry | 422/100 X |
| 4,567,780 | 2/1986 | Oppenlander et al. | 422/100 X |
| 4,616,514 | 10/1986 | Magnussen, Jr. et al. | 73/864.14 |
| 4,784,834 | 11/1988 | Hirschmann | 422/100 |

FOREIGN PATENT DOCUMENTS 3614085 6/1987 Fed. Rep. of Germany .

*Primary Examiner*—David L. Lacey
*Assistant Examiner*—Jeffrey R. Snay
*Attorney, Agent, or Firm*—John F. A. Earley; John F. A. Earley, III

[57] ABSTRACT

A pipetter for picking up, holding and then ejecting a pipet tube, without touching the pipet tube with the hands, which includes a housing, a collet which comprises fingers mounted at the forward end of the housing, and an outer or holding sleeve which closes the fingers when the outer sleeve is positioned forwardly on the housing and which allows the fingers to open when the outer sleeve is retracted on the housing, and an ejector sleeve which has a spring that pushes it against the fingers to open them and eject the tube. The outer sleeve has a holding spring mounted between the housing and the outer sleeve, and the outer sleeve holding spring urges the outer sleeve forwardly to push against the outer surface of the fingers to close them and hold them closed, when the ejector sleeve is pushed into a retracted position in the housing by a pipet tube. When the operator wishes to eject the tube from the pipetter after collecting and discharging its blood sample, he retracts the outer sleeve against the force of the outer sleeve spring, and the ejector spring house moves the ejector sleeve forwardly between the pipetter fingers to open the fingers and to eject the pipet tube.

8 Claims, 3 Drawing Sheets

PIPETTER DEVICE

1. FIELD OF THE INVENTION

This invention relates to a pipetter, and more specifically concerns a pipetter for picking up a pipet tube having a flared end, holding it firmly, drawing a specimen of a fluid into the tube, discharging the specimen of liquid from the tube, and ejecting the tube from the device, without having to touch the tube with the hands, and also relates to a collet assembly having a tube ejection mechanism for ejecting the tube.

2. DESCRIPTION OF THE PRIOR ART

There are a number of problems with conventional pipetters which hold a tube by squeezing O-rings onto the tube by turning down a threaded collet cap. The tube and the collet cap must be manipulated with the fingers, especially when ejecting a used tube from the pipetter.

More problems arise if the used tube has been broken. The blood being tested today may contain an infectious disease, such as AIDS. If a pipetter user breaks the tube as by tapping it or pushing it too hard, the user may cut himself with the broken end of the glass tube and may become infected with AIDS.

Even worse, to reuse a pipetter which is holding a broken tube, the user has to remove the broken piece of tube which is buried deep inside the pipetter, making retrieval difficult, and the user may cut himself while trying to retrieve the broken piece of tube to remove it from the pipetter.

SUMMARY OF THE INVENTION

It is an object of this invention to provide a pipetter that picks up, holds, and ejects a tube without having to touch the tube with the hands.

In accordance with this and other objects of the invention, there is shown a pipetter having a housing and a collet with grasping fingers that are adapted to grasp and hold a flared pipet tube. The fingers are held around the tube by an outer or holding sleeve and the tube is ejected from the pipetter by an inner or ejector sleeve mounted on the housing.

The ejector sleeve has a spring in the housing which pushes the ejector sleeve forwardly to a position in the center of the fingers that spreads their outer ends apart to a ready position, ready to receive a tube.

A holding spring urges the outer or holding sleeve to a position surrounding the inner ends of the fingers to hold the fingers closed around the tube. The fingers cannot close around a tube until the ejector sleeve is moved rearwardly from a position in the central space between the fingers.

To pick up a pipet tube, the user positions the pipetter above a number of spaced-apart vertically positioned tubes in a holder, and selects a tube to be picked up by the pipetter fingers.

The user pushes the pipetter housing downwardly onto the selected tube so the pipet tube pushes the ejector sleeve rearwardly into retracted position away from the central space between the pipetter fingers. When the ejector sleeve passes far enough into the housing that it is no longer positioned between the pipetter fingers, it no longer holds the fingers open, and the outer sleeve spring pushes the outer sleeve forwardly and snaps the fingers closed to grasp the pipet tube. Stop shoulders on the closed fingers, and the flare of the tube, hold the ejector sleeve in retracted position.

Of course, the user may pick up a tube and insert it into the pipetter by hand, if he wishes.

To eject the pipet tube from the device, the outer or holding sleeve is pulled back, which releases the fingers and allows the fingers to open, and the ejector sleeve springs forwardly into the central space between the fingers to open the fingers and to eject the tube.

DETAILED DESCRIPTION OF THE DRAWINGS

Figure 1:
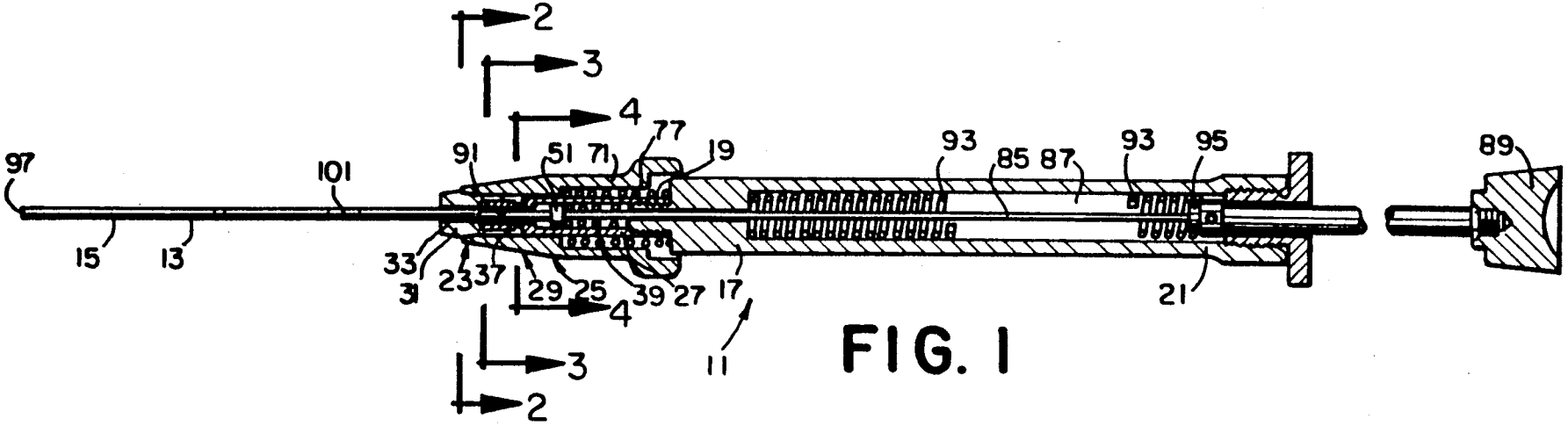
FIG. 1 is a view in vertical section of the pipetter of this invention in a closed position.

Turning now to the drawings, there is shown in FIGS. 1-5, a pipetter 11 for picking up and holding a capillary tube 13, and drawing a specimen of blood or other fluid into chamber 15 of tube 13 by capillary action while venting air from tube 13. The specimen of blood is discharged from tube 13 and then the tube 13 is ejected from the pipetter 11 without having to touch tube 13 with the hands.

Pipetter 11 (FIG. 1) includes a handle sleeve or handle 17 having a threaded front end portion or boss 19 and a rear end portion 21 shaped like a handle.

The front end portion 19 of handle 17 is screwed into collet means 23 (FIG. 5) which is provided for picking up and holding the rear end portion of pipet tube 13, and the collet means 23 includes a collet assembly 25 having a collet housing 27 which is screwed onto the threaded boss 19 of handle 17.

Holding means 29 are provided in collet assembly 25 for grasping and holding tube 13, and the holding means 29 includes a collet 31 having fingers 33, four fingers being shown, which grasp and hold the tube.

Ejection means 35 are provided in the housing 27 for ejecting the tube 13 from the pipetter 11 without touching the tube 13 with the hands, and the ejection means 35 includes an inner or ejector sleeve 37 and an ejector spring 39 which urges sleeve 37 to a forward position.

Collet assembly 25 (FIG. 5) includes the collet housing 27 and a collet 31 which comprises fingers 33 for accepting and holding tube 13. Housing 27 is cylindrical and its front portion includes a cylindrical head 41 of smaller outside diameter than the outside diameter of main portion 43 to which it is connected by a annular groove or neck 45. The rear portion 49 of bore 47 of housing main portion 43 is threadedly connected to the externally threaded boss on front end portion 19 of handle 17. Ejector spring 39 is seated in the rear portion 49 of bore 47, and ejector sleeve 37 is provided with an enlarged head 51 that is adapted to slide back and forth in bore 47.

The inside wall 53 of fingers 33 has an inwardly protruding flange 57 formed at its rear portion which is seated in neck 45 of housing 27. A stop shoulder 59 is formed in the rear of fingers 33 and is adapted to stop forward movement of ejector sleeve 37 when the fingers 33 are closed. Shoulders 59 abut against the forward end 61 of ejector sleeve 37 and prevent sleeve 37 from moving forwardly. The forward portion 63 of fingers 33, when closed, have about the same inside diameter as the outer diameter of the tube 13 so as to grasp the tube 13 firmly. The tubes 13 are provided with an outward flare 65 and the shoulders 59 of fingers 33 are provided with a matching bevel 67 to securely hold tube 13 in position and to hold ejector sleeve 37 in retracted position.

The outer surface 69 of fingers 33 tapers outwardly and is wedged inwardly by outer or holding sleeve 71 when the fingers 33 are closed around a tube 13. Outer sleeve 71 has a bore 73 adapted to slide back and forth on the outer surface of main portion 43 of housing 27. A larger bore 75 of outer sleeve 71 is adapted to house holding spring 77, and a still larger bore 79 of outer sleeve 71 is adapted to slide back and forth on the outside surface of handle 17.

Ejector sleeve 37 is provided with an enlarged head 51, and shoulder 83 of housing 27 acts as a stop for head 51 to limit the forward movement of ejector sleeve 37 and hold it in the collet assembly 25.

Referring now to FIG. 1, a wire plunger 85 is mounted in bore 87 of handle 17 and includes a plunger handle or button 89 at the rear end and a tip 91 at the forward end that may extend into the bore of tube 13. A spring 93 in bore 87 presses against enlarged portion 95 of plunger 85 and urges plunger 85 rearwardly.

Pipetter 11 is especially constructed for use with capillary tubes that draw liquid into the tube by capillary action. Accordingly, the elements of the pipetter vent air from the top of the tube when it is being filled with liquid by capillary action. Wire plunger 85 and its tip 91 are thin enough that air flows around them through pipetter 11 so as to vent the air from the tube and not interfere with the capillary action.

Figure 6:
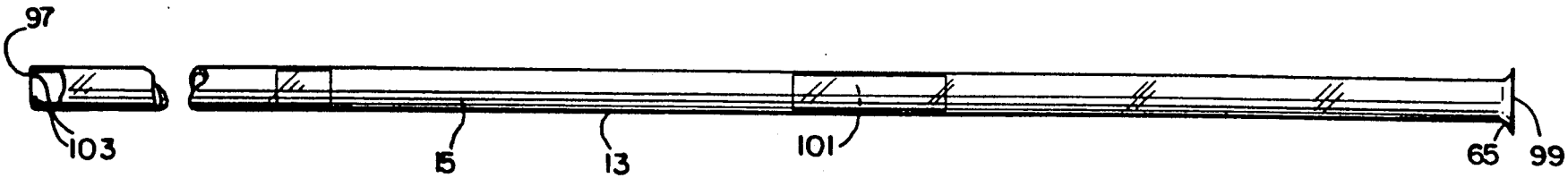
FIG. 6 is a view in vertical section of a pipet tube which may be used with the invention.
Figure 2:
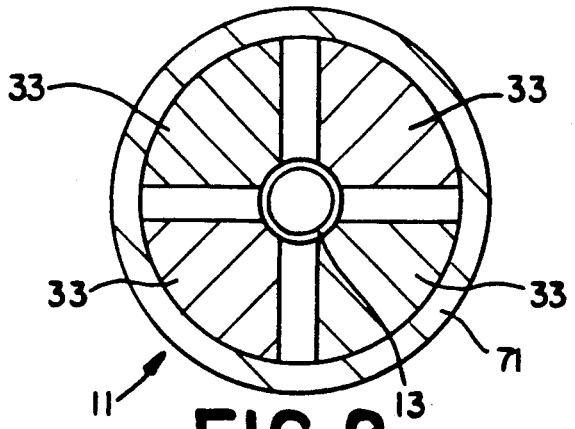
FIG. 2 is a view in vertical section taken as indicated by the lines and arrows 2—2 which appear in FIG. 1.
Figure 3:
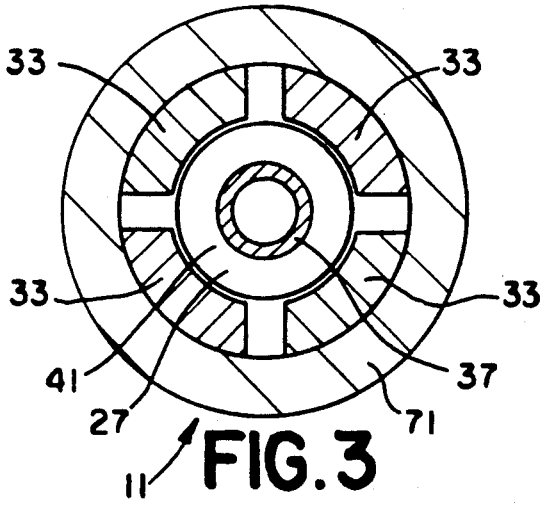
FIG. 3 is a view in vertical section taken as indicated by the lines and arrows 3—3 which appear in FIG. 1.
Figure 4:
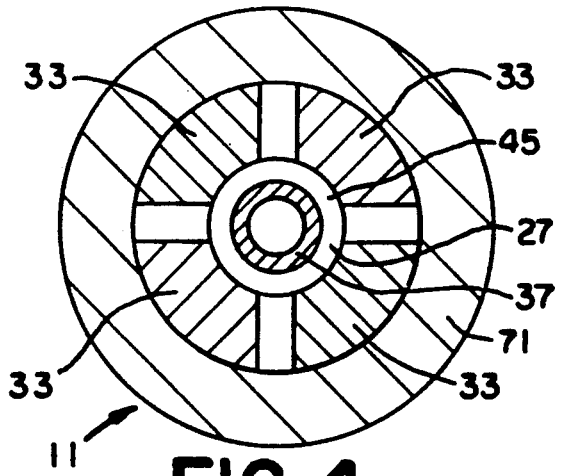
FIG. 4 is a view in vertical section taken as indicated by the lines and arrows 4—4 which appear in FIG. 1.
Figure 5:
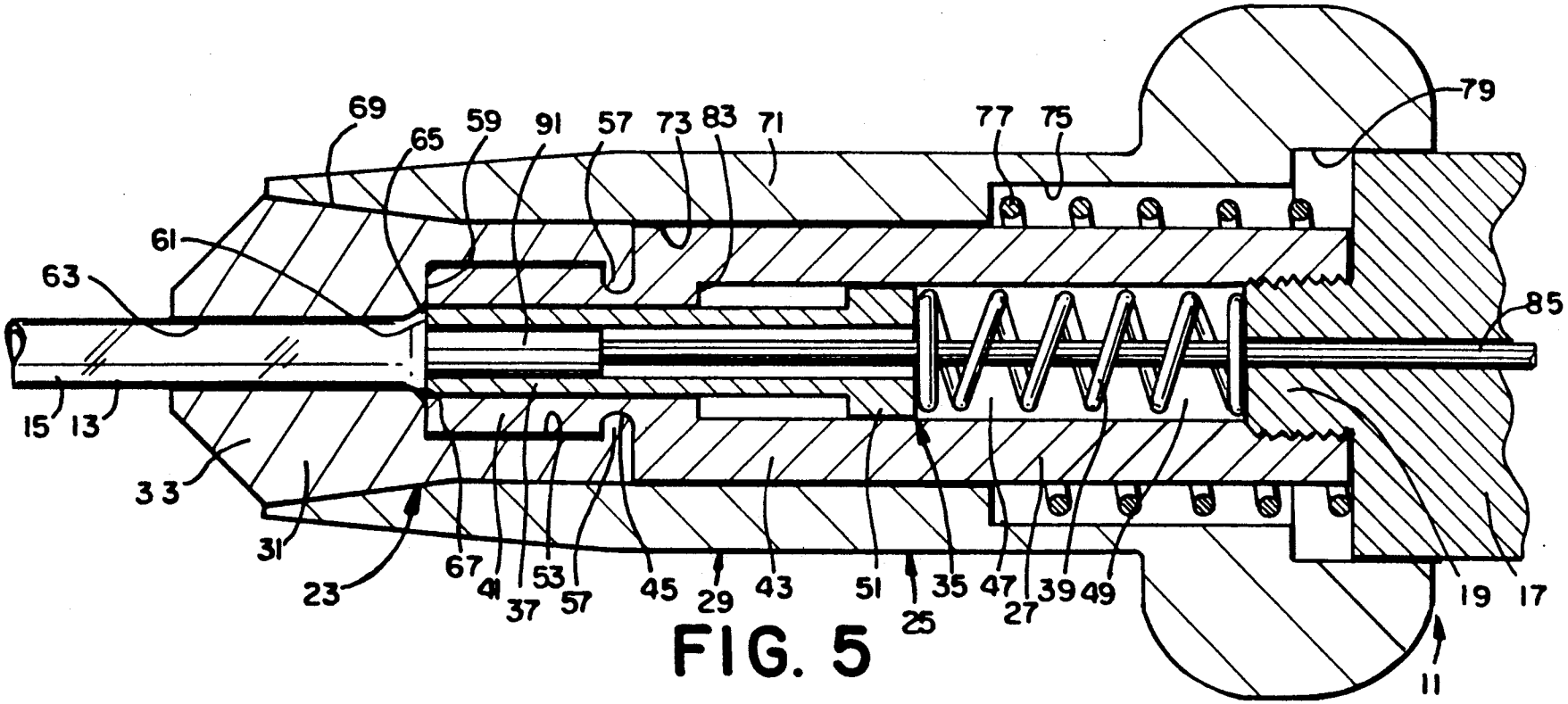
FIG. 5 is a view in vertical section showing the collet portion of the invention in more detail in a closed position holding a pipet tube.

A preferred capillary tube 13 (FIG. 6) which may be used with pipetter 11 is made of glass and has an admitting-discharge end 97 for admitting a liquid and discharging it, and a vent end 99 for passing air from tube 13 as liquid is being drawn into tube 13 by capillary action. The details of tube 13 are disclosed in Drummond Scientific Company U.S. patent application No. 757,608, which was filed in the U.S. Patent and Trademark Office on July 22, 1985 and which is incorporated herein by reference.

A barrier plug 101 is provided for passing air through tube 13 but not liquid, and is positioned in tube 13 at a preselected distance from the admitting-emitting end 97 to define a liquid chamber 15 of preselected volume.

Admitting-emitting end 97 is flared inwardly to provide a stop shoulder 103 that stops the barrier plug 101 from being discharged from tube 13 with the blood sample.

Barrier plug 101 is made of a hydrophobic material that passes air freely to vent it from tube 13 so a not to impede or slow down the capillary action of drawing the liquid into the tube. Barrier plug 101 also stops the passage of air and liquid upon being contacted by the liquid after the chamber 15 has been filled with a preselected volume of liquid.

In operation, when it is desired to pick-up a pipet tube, a number of tubes 13 are stacked in a holder in vertical upright position and spaced apart enough so that the pipetter 11 may pick up a single tube 13. The fingers 33 are open, ejector sleeve 37 is in forward position pushing fingers 33 open and holder sleeve 7 is retracted to permit fingers 33 to open.

The front of pipetter 11 is pressed down onto the top of a selected tube 13, and flare 65 of the tube pushes ejector sleeve 37 into its retracted position. Spring 77 pushes outer sleeve 71 forwardly to close fingers 33 around tube 13 and hold the tube 13 in the pipetter. Tube flare 65 is held in position between bevel 67 of stop shoulder 59 and the forward end of ejector sleeve 37.

After the blood sample has been taken and discharged from tube 13, it is desired to eject the used tube 13 from the pipetter 11 without having to touch it. This is accomplished by pulling back the holding sleeve 71 against the force of its spring 77, which releases fingers 33 and ejector spring 39 pushes ejector sleeve 37 forwardly into the central space between the fingers 33 to push them open. The ejector sleeve also pushes against flare 65 of tube 13 to eject tube 13 forcibly from the pipetter 11 into a trash can.

I claim:

1. A pipetter 11 for picking up a pipet tube 13, holding the pipet tube 13 while in use, and ejecting the pipet tube 13 when desired, without having to touch the pipet tube 13 with the hands, comprising a handle 17 having a front end portion 19 and a rear end portion 21, collet means 23 including a housing 27 mounted on the front end portion 19 of the handle 17 for grasping and picking up and holding the pipet tube 13, holding means 29 on the housing 27 for closing the collet means 23 and for holding the collet means 23 closed on the pipet tube 13 to hold the pipet tube 13, said holding means including a holding sleeve on the handle and means connected to the holding sleeve for biasing the holding sleeve forwardly with respect to said handle, and ejection means 35 in the housing 27 for opening the collet means 23 to admit a pipet tube and for ejecting the pipet tube 13 from the pipetter 11 without touching the pipet tube 13 with the hands, said ejection means including an ejector sleeve and means connected to the ejector sleeve for biasing the ejector sleeve forwardly into said collet means so as to open said collet means.

2. The pipetter of claim 1, wherein the collet means 25 includes finger means 33 for accepting and holding the pipet tube 13 in the pipetter 11, said finger means 33 comprising fingers 33 which are spread apart by the ejection means 35 when the holding means 29 is withdrawn and are snapped closed around the pipet tube 13 by the holding means 29 when the pipet tube 13 is fully inserted into the collet means 25.

3. The pipetter of claim 1, wherein said holding sleeve 71 is mounted on the housing 27, and said means for biasing said holding sleeve comprises a spring 77 urging the holding sleeve 71 forwardly to snap the collet means 25 closed when the pipet tube 13 pushes said ejector sleeve 37 of the ejection means 35 rearwardly out of the way.

4. The pipetter of claim 1, further comprising a plunger 85 mounted in the housing 27 and extending through the rear end portion of the pipetter handle 17 and constructed so as to be extendable through the pipet tube 13 held in the pipetter, and spring means 93 in the pipetter handle 17 connected to the plunger 85 for urging the plunger 85 rearwardly.

5. The pipetter of claim 1, further comprising vent means in the handle 17 for venting air from the handle 17 so that liquid flows into the pipet tube 13 by capillary action.

6. A pipetter 11 for picking up a pipet tube 13 having a flared end 65, holding the pipet tube 13 firmly while in use, and ejecting the pipet tube 13 when desired, without having to touch the pipet tube 13 with the hands, comprising a handle 17 having a front end portion 19 and a rear end portion 21, collet means 23 mounted on the front end portion 19 of the handle 17 for grasping and picking up and holding the pipet tube 13, said collet means 23 also having a stop bevel 67 to position the pipet tube and to prevent forward movement of the pipet tube 13, holding means 29 on the housing 27 for holding the collet means 23 closed on the pipet tube 13 to hold the pipet tube 13, said holding means including a holding sleeve on the handle and means connected to the holding sleeve for biasing the holding sleeve forwardly with respect to said handle, and ejection means 35 in the housing 27 for ejecting the pipet tube 13 from the pipetter 11 without touching the pipet tube 13 with the hands, said ejection means including an ejector sleeve and means connected to the ejector sleeve for biasing the ejector sleeve forwardly into said collet means so as to open said collet means.

7. The pipetter of claim 6, further comprising said collet means 23 having grasping finger means 33 for accepting and holding the pipet tube 13 in the pipetter 11, said finger means 33 forming the stop bevel 67.

8. A pipetter 11 for picking up a pipet tube 13, holding the pipet tube 13 while in use, and ejecting the pipet tube 13 when desired after use, without having to touch the pipet tube 13 with the hands, comprising a handle 17 having a front end portion 19 and a rear end portion 21, collet means 23 including a housing 27 mounted on the front end portion 19 of the handle 17 for grasping and picking up and holding the pipet tube 13, holding means 29 on the housing 27 for closing said collet means and for holding the collet means 23 closed on the pipet tube 13 to hold the pipet tube 13, and ejection means 35 in the housing 27 for opening said collet means to admit the pipet tube and for ejecting the pipet tube 13 from the pipetter 11 without touching the pipet tube 13 with the hands, the collet means 25 including finger means 33 for accepting and holding the pipet tube 13 in the pipetter 11, said finger means 33 comprising fingers 33 which are spread apart by the ejection means 35 when the holding means 29 is withdrawn and are snapped closed around the pipet tube 13 by the holding means 29 when the pipet tube 13 is fully inserted into the collet means 25, the holding means 29 being an outer holding sleeve 71 mounted on the housing 27, a spring 77 urging the holding sleeve 71 forwardly to snap the collet means closed when the pipet tube pushes an ejector sleeve 37 rearwardly out of the way, the ejector means including a spring 39 mounted in the housing 27 that urges the ejector sleeve 37 forwardly to open the collet means 25, a plunger mounted in the housing and extending through the rear end portion of the pipetter handle 17, and spring means 93 in the pipetter handle 17 connected to the plunger 85 for urging the plunger 85 rearwardly.

* * * * *